US009701906B2

(12) United States Patent
Brown

(10) Patent No.: US 9,701,906 B2
(45) Date of Patent: Jul. 11, 2017

(54) METHOD FOR FEEDING A FLUIDIZED BED COKING REACTOR

(75) Inventor: Wayne Brown, Calgary (CA)

(73) Assignee: ETX SYSTEMS INC., Calgary (CA)

( * ) Notice: Subject to any disclaimer, the term of this patent is extended or adjusted under 35 U.S.C. 154(b) by 989 days.

(21) Appl. No.: 13/997,167

(22) PCT Filed: Dec. 23, 2011

(86) PCT No.: PCT/CA2011/001392
§ 371 (c)(1),
(2), (4) Date: Sep. 6, 2013

(87) PCT Pub. No.: WO2012/083431
PCT Pub. Date: Jun. 28, 2012

(65) Prior Publication Data

US 2013/0341174 A1 Dec. 26, 2013

Related U.S. Application Data

(60) Provisional application No. 61/426,870, filed on Dec. 23, 2010.

(51) Int. Cl.
*C10B 47/24* (2006.01)
*C10B 49/22* (2006.01)
*C10B 55/10* (2006.01)

(52) U.S. Cl.
CPC ..... *C10B 47/24* (2013.01); *C10B 49/22* (2013.01); *C10B 55/10* (2013.01)

(58) Field of Classification Search
CPC ..... C10B 49/22; C10B 47/24; C10B 55/10
See application file for complete search history.

(56) References Cited

U.S. PATENT DOCUMENTS 2,788,312 A 4/1957 Moser, Jr.
2,808,368 A 10/1957 Moser, Jr.
(Continued)

FOREIGN PATENT DOCUMENTS

| | | |
|---|---|---|
| CN | 101911275 | 12/2010 |
| GB | 759720 | 10/1956 |
| GB | 768209 | 2/1957 |

OTHER PUBLICATIONS

English Abstract of CN 101911275, obtained from espacenet.com on Mar. 15, 2015.
(Continued)

*Primary Examiner* — Shogo Sasaki
(74) *Attorney, Agent, or Firm* — Davis Wright Tremaine LLP; Heather M. Colburn

(57) ABSTRACT

A fluidized bed coking reactor apparatus comprises a reaction vessel; a temperature sensor inside the reaction vessel for measuring a reactor temperature, a solids feed mechanism for feeding solid particles into the reactor vessel at a mass flow rate, a feed material feed mechanism for feeding feed material into the reactor at an operating feed rate; and a supervisory controller programmed to determine an upper feed material feed rate of the reactor when operating at the reactor temperature and receiving solid particles at the mass flow rate. The upper feed material feed rate is defined as a feed rate of feed material deposited onto a selected fraction of a fluidized bed of solid particles that causes defluidization in the reactor when the reactor is operating under conditions having a selected degree of backmixing in the fluidized bed, wherein the degree of backmixing is modeled as a selected number of reactors arranged in series and each operating under continuous well-mixed conditions, with the selected number of reactors being an integer between one and infinity.

13 Claims, 5 Drawing Sheets

(56) References Cited

U.S. PATENT DOCUMENTS

| | | | | |
|---|---|---|---|---|
| 2,888,398 | A | 5/1959 | Griffin, Jr. | |
| 4,445,919 | A * | 5/1984 | Cole | B01J 8/36 134/166 R |
| 5,658,455 | A * | 8/1997 | Hammond | C10G 9/005 208/106 |
| 5,714,056 | A * | 2/1998 | Hammond | C10C 3/002 208/113 |
| 7,033,486 | B2 * | 4/2006 | Gorbaty | C10G 9/32 208/106 |
| 7,419,585 | B2 * | 9/2008 | Maa | C10G 9/32 208/113 |
| 2005/0279671 | A1 | 12/2005 | Monaghan et al. | |
| 2010/0279014 | A1 | 11/2010 | Hiroki | |
| 2012/0211402 | A1 * | 8/2012 | Monaghan | B01J 4/002 208/308 |

OTHER PUBLICATIONS

Gray, "Fundamentals of Bitumen Coking Processes Analogous to Granulations: A Critical Review," The Canadian Journal of Chemical Engineering, 80:3, Jun. 2002, pp. 393-401.

Darabi, et al., "Agglomeration of Bitumen-Coated Coke Particles in Fluid Cokers," International Journal of Chemical Reactor Engineering, 8:A122, Jul. 19, 2010, pp. 1-22.

International Search Report and Written Opinion received in International Application No. PCT/CA2011/001392 filed Dec. 23, 2011, dated Mar. 12, 2012, 11 pages.

* cited by examiner

METHOD FOR FEEDING A FLUIDIZED BED COKING REACTOR

FIELD OF THE INVENTION

This invention relates generally to thermal processing of liquid hydrocarbons in a fluidized bed coking reactor.

BACKGROUND

Fluidized bed technologies have been applied to a type of hydrocarbon processing known as "coking". In a commercial coking process a hydrocarbon feed is reacted at temperatures greater than approximately 350° C., and typically greater than 430° C., but typically less than 580° C. The targeted chemical species of the coking process reside for the most part in the "pitch" fraction of the feed, typically defined as the fraction of the oil that boils above 524° C., based on standard industry test methods. A number of fluid bed coking reactors have appeared in the patent literature since the 1940s, an example of which is disclosed in U.S. Pat. No. 2,895,904. The term "Fluid Coking" has become synonymous with the coking reactor described in this patent.

Another example of a conventional Fluid Coking reactor 15 having a fluidized bed 23 is shown in FIG. 1 (PRIOR ART). In the Fluid Coking process, hot solid particles enter the reactor 15 in a freeboard region 19, above the surface of the fluid bed 23 and are fluidized by fluidization gas. Solid particle withdrawal occurs at the bottom of the reactor 15. Feed is sprayed in the liquid phase into the fluid bed 23 at several different elevations 20 where it coats a portion of the fluidized solid particles. The nature of the solids mixing in the fluidized bed leads to the condition that solid particles within the fluidized bed is generally well mixed.

In the conventional Fluid Coking reactor shown in FIG. 1, a fraction of the feed consists of a liquid phase pitch that is distributed onto a fluidized bed of heated coke solid particles with the solid particles providing the thermal energy for the cracking reactions. The cracking reactions generate a solid hydrocarbon byproduct ("coke") that is deposited onto the solid particles that were initially coated with liquid-phase pitch. The surface area provided by the fluidized solid particles results in a relatively high rate of heat transfer for these reactors. The Fluid Coking process is continuous, with solid particles being added and withdrawn at the same rate. After withdrawal the solid particles are heated up before being reintroduced back into the reactor. In addition, since coke is deposited onto the fluidized solids the solids inventory increases, and an equivalent amount of the solids must be purged in order to maintain steady state conditions within the reactor.

An operational challenge that exists with fluidized beds is to maintain fluidized conditions. When a bed "defluidizes" the drag force imparted by the movement of the gas relative to the solid particles is no longer able to support the weight of the solid particles. The bed then "slumps", and intimate contact between the solid particles is re-established as the bed is no longer fluidized. A bed that is defluidized is said to be a "packed bed" of solids. Defluidization of a fluid bed during operation constitutes a serious operational challenge, since loss of bed fluidity results in a system that behaves in a manner that is inconsistent with a continuous fluid.

For a petroleum oil application in which the fluidized solid particles provide the energy required to convert a liquid hydrocarbon feed into lower boiling products and a condensed coke byproduct, the situation only worsens following a defluidization event. Any liquid present in the system at the time of the defluidization incident will continue to react. The coke formed will bridge the adjacent solids together, essentially cementing the entire bed together as a single cohesive unit. This problem is magnified if fresh feed addition is continued after the defluidization event. The end result is that the processing unit has to be shut down for maintenance, which requires the solid mass to be cut out of the reactor using water lasers, or other mechanical means. This activity is taken at considerable expense, with implications both upstream and downstream in the refinery.

The mechanism by which defluidization is initiated by the agglomeration of wet particles is of particular importance in a fluidized bed coking process. When a fluidized bed coking reactor defluidizes due to the introduction of too much liquid feed, the bed is said to have "bogged", and the processes leading to the bogged bed is referred to as "bogging". British patent 759,720 discloses operational guidelines for feeding a Fluid Coking process for converting a heavy hydrocarbon feed to lower boiling products, and in particular, defines a maximum feed rate below which defluidization by bogging will be avoided. In this patent, a Fluid Coking process is disclosed wherein hot fluidized solids are fed continuously into a fluid bed coking reactor, with cool solids withdrawn at the same rate. As described in the patent, the bulk of the data were obtained in a laboratory-scale fluidized bed unit in which the fluidized solids were not added or withdrawn from the reactor; this mode of operation is referred to in the basic chemical engineering literature as a "fed batch" reactor. Data from the fed batch reactor were used to empirically formulate a mathematical relationship used to calculate the maximum possible feed rate at which fluidized conditions could be maintained. The inputs to the model were: the reactor temperature, and the amount of coke forming material in the fresh feed, as determined by the standard "Conradson Carbon Number (CCR)" test. It is well known within the industry that the "Micro Carbon Residue (MCR)" test or equivalent could be applied effectively in place of the CCR. An empirical factor was included that captures the impact of scale-up, the efficiency of feed distribution on the particles, the characteristics of the fluidized solids, and the fluidization gas rate.

While British patent 759,720 discloses a method to feed a Fluid Coking process, the data accumulated for the model were acquired using a fed batch reactor. A fed batch reactor configuration substantially differs from the Fluid Coking process, the most significant difference being no circulation of solids in a fed batch reactor. Therefore, it is unclear whether it is accurate to base the prediction of defluidization in a fluid bed coking reactor from data obtained from a fed batch reactor. Further, British patent 759,720 does not provide any insight into how to efficiently operate a fluidized bed reactor exhibiting mixing characteristics that are not well mixed with respect to the fluidized solids. In particular, it is not clear how applicable the method disclosed in British patent 759,720 is for feeding a fluidized bed reactor with primarily plug flow characteristics, such as a cross-flow fluidized bed reactor as disclosed in Applicant's own PCT publication no. WO 2005/040310.

SUMMARY

According to one aspect of the invention, there is a provided a fluidized bed coking reactor apparatus comprising: a reaction vessel having a feed material inlet, a solids inlet, a solids outlet and a fluidization gas inlet; a temperature sensor inside the reaction vessel for measuring a reactor temperature profile; a solids feed mechanism in communication with the solids inlet for feeding solid particles into the reactor vessel; a feed material feed mechanism in communication with the feed material inlet for feeding feed material into the reactor; and a supervisory controller. The controller is communicative with the temperature sensor to monitor the reactor temperature profile, the solids feed mechanism to monitor and control a mass flow rate of the solid particles, and the feed material feed mechanism to control a rate of feeding feed material into the reactor. The controller has a memory encoded with steps and instructions executable by the controller to determine an upper feed material feed rate which is a feed material feed rate that causes defluidization in the reactor when the reactor is operating under conditions having a selected degree of backmixing in the fluidized bed and wherein the upper feed material feed rate is a function of the solid particles mass flow rate, the reactor temperature profile, mixing characteristics of the reactor, and properties of: the feed material, the solid particles, and a fluidization gas fed into the reactor. The memory is further enclosed with executable steps and instructions to compare the feed material set point feed rate to the determined upper feed material feed rate and when the feed material set point feed rate is greater than the upper feed material feed rate, to control the feed material feed mechanism to feed material at a set point feed rate $F_{SP}$ or control the solids feed mechanism to feed solid particles at a mass flow rate S so that the feed material set point feed rate is at or below the upper feed material feed rate.

According to another aspect of the invention, there is provided a method of operating a fluidized bed coking reactor comprising:

(a) monitoring a mass flow rate of solid particles being fed into the reactor;

(b) monitoring a temperature profile in the reactor;

(c) feeding a feed material onto a fluidized bed of the solid particles in the reactor at a feed material set point feed rate;

(d) determining an upper feed material feed rate which is a feed material feed rate that causes defluidization in the reactor when the reactor is operating under conditions having a selected degree of backmixing in the fluidized bed and wherein the upper feed material feed rate is a function of the solid particles mass flow rate, the reactor temperature profile, mixing characteristics of the reactor, and properties of: the feed material, the solid particles, and a fluidization gas fed into the reactor; and (e) comparing the feed material set point feed rate to the determined upper feed material feed rate and when the feed material set point feed rate is greater than the upper feed material feed rate, adjusting the feed material set point feed rate or the solid particles mass flow rate so that the feed material set point feed rate is at or below the upper feed material feed rate.

According to yet another aspect of the invention, there is provided a computer readable medium encoded with steps and instructions executable by a controller to determine an upper feed material feed rate of a fluidized bed coking reactor operating at a reactor temperature profile and receiving solid particles at a mass flow rate, wherein the upper feed material feed rate is defined as a feed rate of feed material deposited onto a selected fraction of a fluidized bed of solid particles in the reactor that causes defluidization in the reactor when the reactor is operating under conditions having a selected degree of backmixing in the fluidized bed, and wherein the upper feed material feed rate is a function of the solid particles mass flow rate, the reactor temperature profile, mixing characteristics of the reactor, and properties of: the feed material, the solid particles, and a fluidization gas fed into the reactor.

DETAILED DESCRIPTION OF EMBODIMENTS OF THE INVENTION

Introduction and Terminology

The embodiments described herein relate to an improved coking process for converting a feed material ("feed") into various product materials ("products") using a fluidized bed coking reactor ("primary upgrading reactor" or "reactor") at feed rates that avoids defluidization of solid particles (otherwise known simply as "solids") that are fluidized by a fluidization gas in the reactor.

The feed in these embodiments is a liquid-phase hydrocarbon stream of which at least a fraction undergoes a chemical reaction in the primary upgrading reactor. The feed can consist of a pitch stream received from a fractionator apparatus, along with some gas oil material, wherein "gas oil" refers to the fraction of oil that boils below 524° C., but above 177° C., measured using standard industry test methods. The feed may be comprised of a single substance or may be comprised of a plurality of substances. The liquid products may be comprised of a single product or substance, or a plurality of products or substances, and are typically the commercially desired products from the fluidized bed coking process.

When the feed is fed into the primary upgrading reactor, some of the liquid-phase pitch is vaporized without reacting ("volatile pitch"), and the remainder of the pitch remains on the solid particles and is eventually reacted to form coke, non-condensable gases, and liquid product ("reacting pitch").

All gaseous material exiting the fluidized bed coking reactor is referred to as the "reactor vapour" or "reactor gases", and include the liquid products, non-condensable gases, fluidization gas, and the volatile pitch. A component of the reactor gases known as "reactor product" refers to all of the hydrocarbon vapours exiting the reactor (liquid products, non-condensable gases, and volatile pitch) and in particular does not include the fluidization gas.

Apparatus

Figure 1:
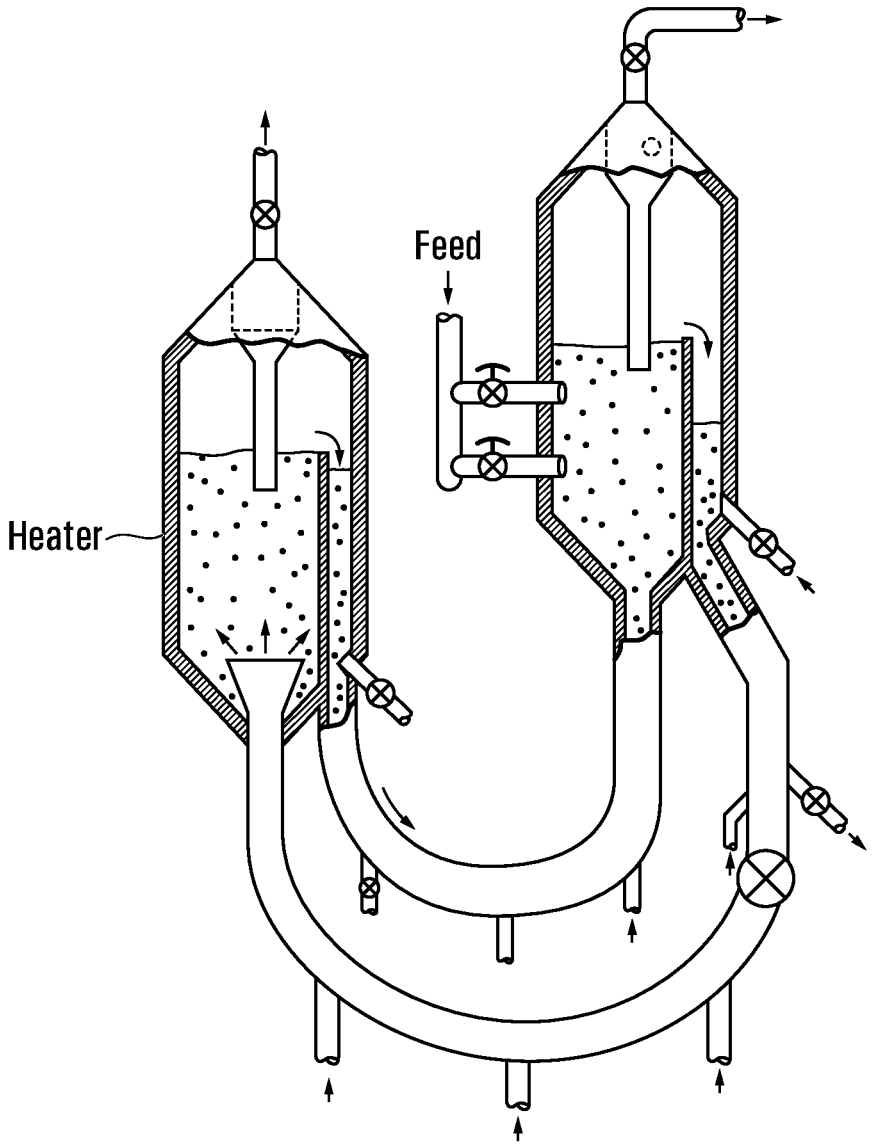
FIG. 1 is a schematic drawing of a conventional Fluid Coking reactor (PRIOR ART).
Figure 2:
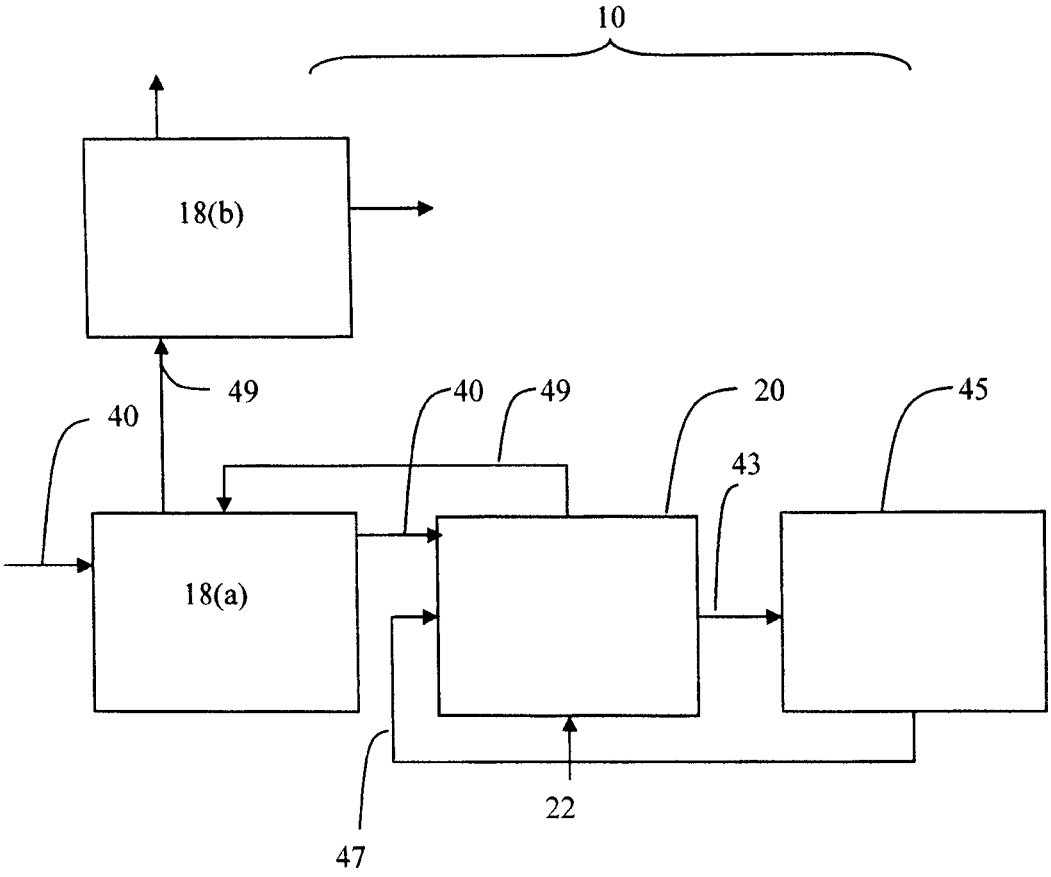
FIG. 2 is a flowsheet showing of a fractionator, a cross-flow fluidized bed reactor and a heater according to one embodiment of the invention.

Referring now to FIG. 2, a liquid-phase feed 40 consisting primarily of a pitch stream with some gasoil is fed into a scrubber portion 18(*a*) of a fractionator apparatus wherein the feed material 40 is contacted by heated reactor gases 49 from a primary upgrading reactor 20; a primary upgrading reactor suitable for use with a hydrocarbon processing system 10 is disclosed in Applicant's Canadian patent 2,505,632. The heated reactor gases 49 act as a stripping medium and assist in the separation of pitch from the gasoil in the feed material 40; the pitch and some of the gasoil in the feed exit the bottom of the scrubber 18(*a*) and are introduced as a liquid phase feed stream 40 into the primary upgrading reactor 20.

Figure 3:
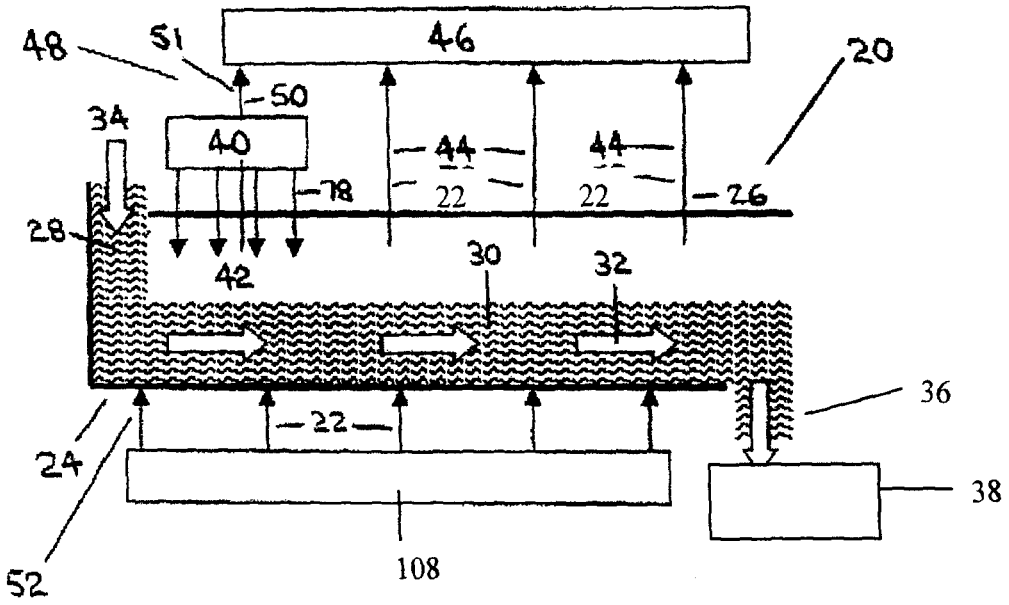
FIG. 3 is a schematic drawing of a cross-flow fluid bed reactor.

As shown in FIG. 3, the primary upgrading reactor 20 is a cross-flow fluidized bed reactor 20. While such reactor 20 is suitable for the process described herein, other fluidized bed coking reactors exhibiting any degree of back-mixing flow characteristics as is known in the art may also be used. For the reactor 20, a gaseous fluidizing medium 22 is introduced into a reaction vessel of the reactor 20 by an injector 108 through fluidization gas inlets at the bottom of the reactor vessel base 24 and exits at the top of the reactor vessel so that the fluidizing medium 22 moves in a substantially vertical fluidizing direction 26. The fluidizing medium 22 fluidizes heated solid particles 28 to produce a fluid bed 30. The fluidization medium in this embodiment is a gas at reactor conditions. The solid particles 28 in the fluid bed 30 can be sand or coke particles, or any other solid with the appropriate fluidization characteristics, and are fed into the reactor 20 by a solids feed mechanism (not shown in this Figure but shown schematically as item 106 in FIG. 5). The solid particles 28 move in a substantially horizontal solid transport direction 32 inside the reaction vessel, from a solids inlet 34 at an upstream horizontal position in the reactor 20 to a solids outlet 36 at a downstream horizontal position in the reactor 20. The solid particles 28 are collected in a solid collection apparatus 38 which is associated with the solids outlet 36. In this embodiment, the solid particles 28 move in the solid transport direction 32 substantially under the influence of gravity. In other words, no mechanical device or apparatus is used to move the solid particles 28.

The solids feed mechanism 106 can be one of several solids transfers systems as known in the art; for example, the solids feed mechanism can be a standpipe/riser arrangement used in commercial fluid coking and which comprises a slide valve to regulate solids flow. The solids flow rate in such a mechanism can be measured by measuring the pressure drop across the valve. Other types of solids feed mechanism do not use a slide valve and instead can use a loop seal or a rotary or "star" valve. In systems with a loop seal, the solids flow is modulated by changing the rate of aeration gas introduced into the seal. As such the rate of solids transfer can be calculated by determining the amount of gas added to the loop seal, and the pressure drop through the loop seal; in systems that use a rotary valve the solids flow rate can be determined by the rotational speed of the rotary valve. Still another approach to determining solids flow rate is by heat balance, wherein measuring the temperature at key locations with the system can be used to determine the heat properties of the flowing system and thus the flow rate of solids within the system.

The feed material 40 is introduced into the reactor 20 at a feed material inlet 42 by a feed material feed mechanism (not shown in this Figure but shown schematically as item 110 in FIG. 5) which is located downstream of the solids inlet 34 so that the feed material inlet 42 is between the solids inlet 34 and the solids outlet 36. The feed material 40 in this embodiment is a liquid-phase stream introduced into the fluidized bed by means of nozzles (not shown), introduced either onto the top of the free surface of the fluidized bed, or directly into it. The flow rate of feed material can be controlled by control valves communicative with the nozzles; as will be discussed below, a controller can regulate the control valves to discharge the feed material at a feed material set point feed rate $F_{SP}$. When the feed material 40 contacts the fluidized bed of solid particles, some of the pitch is vaporized without reacting ("volatile pitch"); the remainder of the pitch remains on the solid particles and is eventually reacted to form coke, non-condensable gases, and liquid product ("reacting pitch"). Some of the reacting pitch may be redistributed after the initial introduction of feed, being partially transferred from the coated to the non-coated particles. The energy contained in the fluidized solids support the chemical conversion of the feed into products that continue until almost all of the feed material has been exhausted in the reactor 20. The solid particles 28 drop in temperature as the feed reacts and the reactor 20 is operated so that the solid particles are free or almost free of reacting pitch by the time the solids leave the reactor 20.

Referring again to FIG. 2, the cooled solid particles exit the reactor 20 and are transported through a cooled solids transfer line 43 to a heater 45. The cooled solids are heated in the heater 45 and are returned to the reactor 20 via a heated solids transfer 47 line to maintain a mean operating temperature of around 500° C. In this embodiment, the heater 45 is a partial oxidizer (PDX) vessel (not shown) that partially oxidizes a portion of the coke; alternatively, other heaters known to those skilled in the art that are suitable for heating the solid particles can also be used. The PDX vessel is a fluidized vessel in which the coke is partially combusted under oxygen limiting conditions, at a temperature typically on the order of 650° C. The PDX vessel is implemented primarily to heat the solids, but can also used to preheat the fluidization gas to the reactor 20, and to partially meet the site demand for superheating low grade steam. The PDX vessel may be equipped with two different sets of heat exchange coils through which fluidization gas and steam are circulated and heated. The heated solid particles are returned from the PDX vessel to the reactor 20 via heated solids transfer line 47.

At typical reactor operating conditions about 65% by weight of the pitch contacting the solids is reacting pitch that coats the solids and is eventually converted into either coke or liquid or non-condensable gas products in the reactor 20. The remaining 35% of the liquid pitch material is volatile pitch which vaporizes without reacting or coating the solids and exits the reactor 20 with other the reactor products; after exiting the reactor 20, the volatile pitch in the reactor product is condensed and separated from the liquid products in the fractionator apparatus 18 and then is recycled back to the reactor 20 along with fresh feed material 40.

Referring again to FIG. 3, products converted from the feed in the reactor 20 include all of the hydrocarbon vapours exiting the reactor and is collectively referred to as reactor product and shown as reference number 44. The reactor product 44 comprises lower boiling hydrocarbon products, typically with boiling points less than 524° C., and include the liquid products, non-condensable gases, and volatile pitch. The reactor product 44 is collected in a vapor collection apparatus 46 which is located at an upper vertical position 48 above the solid particles 28 and the fluid bed 30. The vapor collection apparatus 46 includes a plurality of vapor phase product collection locations 50. The reactor product collection locations 46 are spaced horizontally between the solids inlet (34) and the solids outlet 36. A vaporized fraction 51 of the feed material 40 is also collected at one or more of the vapor phase product collection locations 46 adjacent to the feed inlet 42, and represents a fraction of the reactor product 44. The fluidizing medium 22 is also collected in the vapor collection apparatus 46 with the reactor product 44 so that the fluidizing medium passes from a lower vertical position 52 below the solid particles 28 to the vapor collection apparatus 46 at the upper vertical position 48.

Referring again to FIG. 2, the reactor product 44 along with the fluidizing medium 22 collectively form reactor gases 49 and is routed to the scrubber portion 18(*a*) of the fractionator apparatus wherein the reactor gases 49 contact the incoming feed stream 40. The reactor gases 49 then flow to a fractionation unit 18(*b*) of the fractionation apparatus, wherein the vapor phase product 44 is separated from the fluidizing medium 22 and quenched in order to minimize further conversion and degradation of the vapor phase product 44.

Determining Feed Rate in an Improved Coking Process for a Generalized Fluidized Bed Reactor The improved coking process of the present embodiments operates a fluidized bed reactor to process as much feed, and hence produce as much commercially useful product as possible without causing the fluidized bed to defluidize, or worse still, to bog. To determine the maximum feed rate that can be sustained before defluidization by a bogging mechanism occurs, the mixing characteristics and the solid particle throughput of the fluidized bed must be considered. The following concepts and definitions are used as part of this derivation:

- At any given time the fluid bed solids can be classified as either "wet" with unreacted liquid, or as "dry". As the concentration of wet particles increases the interaction between these particles, and the likelihood of forming agglomerates, increases. Therefore the concentration of wet particles dictates the propensity of the bed to defluidize.
- As discussed above, the pitch can be classified into two fractions: 1) a volatile" fraction, that volatilizes within a short time period following the initial contact with the fluidized solids, and 2) a "reacting pitch" fraction, a portion of which resides on the fluidized solids until it reacts to liberate non-condensable gas and liquid product material, and solid coke. The reacting pitch fraction is viscous and "tacky" in nature and hence has an ability to seed the formation of agglomerates. Hence this fraction is influential in the defluidization process by a bogging mechanism. Depending upon the thermodynamic conditions that exist within the reactor volatile pitch may represent on the order of 25-35% of the total pitch material. This material is condensed, separated, and recycled to the fluidized bed reactor 20. In this manner full conversion of the reacting pitch liquid can be achieved.
- Recent work in the public domain has shown that the reacting pitch remains "tacky" until conversion levels greater than approximately 95% have been attained. As a result "dry" particles may be generated from tacky wet particles whose liquid coatings have achieved a 95% conversion level or greater.

With these concepts the desired relationships governing the feeding of a fluidized bed coking reactor to avoid defluidization can be developed and is described below.

In a fed-batch process, liquid feed is continually added to a fluidized bed of solids, but no fresh solids are added, and no solids are removed. It is understood in this case that an external heat source is required to add energy to the fluidized solids in order to initiate the chemical reactions. This energy can be provided by an electrical heater, as disclosed in British patent 759,720. At steady state, a mass balance on the reactor dictates that the rate at which the pitch liquid fraction is added to the reactor must equal the sum of the rate at which the volatile pitch leaves the reactor and the rate at which the reacting pitch is converted due to chemical reaction. This is shown mathematically in equation (1), where $F_K$ is the rate at which the reacting pitch fraction is added to the reactor (lb/hr), $V_K$ is the rate at which the volatile pitch exits the reactor as vapour (lb/hr), $r_K$ is the rate of disappearance of the reacting pitch fraction (lb liquid/lb dry fluidized bed material-hr), and $m_b$ is the inventory of fluidized solids in the bed prior to feed introduction (lb).

$$F_K = V_K + r_K m_b \qquad \text{equation (1)}$$

The coke forming propensity of a liquid hydrocarbon under standardized conditions can be determined using industry-standard characterizations, such as the Conradson Carbon Residue (CCR) test. The actual amount of coke produced is related the standardized coking propensity through the "coke producing factor" (CPF), defined as the mass of coke produced in the actual coking environment per mass of coke produced by the same feed under the standardized environment. With this definition the rate of accumulation of coke in the reactor is given by the expression $(FC_F - PC_P)\pi = F\Delta_{CCR}\pi$ where F is the total feed rate of hydrocarbon feed to the reactor (lb/hr), $C_F$ is the amount of coke formed from the feed under standardized coking conditions (lb coke/lb hydrocarbon), P is the rate of condensable liquid products exiting the reactor (lb/hr), $C_P$ is the amount of coke formed from the condensable liquid products under standardized coking conditions (lb coke/lb hydrocarbon), $\pi$ is the CPF, defined above, and $\Delta_{CCR}$ is the fraction of coke forming material in the feed to the reactor, determined under standardized conditions destroyed in the reactor (lb CCR/lb feed). From the expression above $\Delta_{CCR}$ is implicitly defined as $\Delta_{CCR} = C_F - (P/F)C_P$.

The rate of reacting pitch fraction deposited on the bed is related to the rate of coke production through stoichiometry by the expression:

$$F_K - V_K = \frac{F\Delta_{CCR}\pi}{\alpha_{KC}} \qquad \text{equation (2)}$$

where $\alpha_{KC}$ is the stoichiometric coefficient associated with the formation of coke from the reacting pitch sub-fraction (lb coke produced/lb liquid reacted). Substituting this expression into equation (1) and expanding the rate equation in equation (1):

$$\alpha_{KC} k_K \left(\frac{m_K}{m_b}\right) = \frac{F\Delta_{CCR}}{m_b}\pi \qquad \text{equation (3)}$$

where $k_K$ is the first order rate constant associated with the disappearance of the reacting pitch fraction of the feed by chemical reaction ($hr^{-1}$), and $m_K$ is the mass of the reacting pitch fraction in the reactor at steady state.

The bed has a natural capacity to resist defluidization, determined by the degree of shear in the bed, and other factors that will be discussed. At a particular operating condition, as the feed rate of the reacting pitch to the reactor is increased, this natural capacity is exceeded and the bed defluidizes by the bogging mechanism described above. The critical concentration of the reacting pitch at which this occurs is given by the quantity $(m_K/m_b)^*$. With this definition the maximum allowable feed rate of the feed to the reactor in order to prevent defluidization is given by equation (4) as:

$$\frac{F}{m_b} \leq \frac{k_K}{\pi \Delta_{CCR}} \alpha_{KC} \left(\frac{m_K}{m_b}\right)^* \quad \text{equation (4)}$$

This equation states that the amount of reacting pitch fraction that can be added at steady state is limited by the rate at which it is converted to non-condensable gas and liquid products and coke in the reactor. From chemical reaction theory, the rate constant is temperature dependent, and can be expressed by the well known Arrhenius relationship as:

$$k_K = \Delta \exp(-E_a/RT) \quad \text{equation (5)}$$

Where A is the pre-exponential factor ($hr^{-1}$), $E_a$ is the activation energy (cal/mol), R is the universal gas constant (cal/mol-K), and T is the temperature (K) of the reactor. Since a fed batch reactor is well-mixed, this temperature is uniform throughout the reactor.

Combining this temperature dependence with equation (4) yields the desired final result governing the safe operation of a fed batch reactor.

$$(F)_{FB} \leq \frac{\alpha_{KC}(m_K/m_b)^*}{\pi \Delta_{CCR}} [m_b A \exp(-E_a/RT)] \quad \text{equation (6)}$$

This equation relates the amount of feed that can be fed to a fluidized bed of particles, if no particles are added to or removed from the reactor. Here the subscript "FB" is used to identify that the constraint is specific to the fed batch reactor system. In descriptive terms, the rate at which a fed-batch reactor can accept feed is limited by the rate at which the tacky particles dry out by chemical reaction.

The results of this derivation are comparable to the findings disclosed in British patent 759,720 for the fed batch reactor disclosed in that patent, except with respect to three important and relevant distinctions:

1. The present approach is derived from chemical reaction engineering principles and hence the general approach can be applied to any reactor configuration including well-mixed, continuous, bubbling fluidized bed coking reactors. The approach taken in British patent 759,720 is based on empirical observations of a fed batch process and thus that approach should be limited to fed batch reactor designs only.
2. The present derived approached clearly shows the limitations of applying the empirical findings disclosed by British patent 759,720 to continuous throughput well mixed reactors, and in particular to Fluid Coking processes.
3. The present derived approach recognizes that actual coke production is related to that under standardized conditions by the CPF. In British patent 759,720 this factor is absent, and thus limits the utility of its approach to processes where the CPF is unity.

The appropriate formulation for a continuous, well-mixed fluid bed coking reactor considers the fact that the process is continuous with respect to coke addition and removal, and that the solid particles in the fluid coking reactor are well mixed. With these considerations, at steady state the net rate at which the reacting pitch fraction is deposited on the bed must equal the rate at which it is advected out of the reactor on the withdrawn solids, and the rate at which the reacting pitch fraction reacts. Mathematically this is given by the equation:

$$F_K - V_K = r_K m_b + S\left(\frac{m_K}{m_b}\right) \quad \text{equation (7)}$$

Making the same substitutions as introduced above, and rearranging, the following condition to avoid defluidization is derived:

$$(F)_{CSTR} \leq \frac{\alpha_{KC}(m_k/m_b)^*}{\Delta_{CCR}\Pi} [m_b A \exp(-E_a/RT) + S] \quad \text{equation (8)}$$

where S is the rate at which solids are continuously introduced into the reactor (lb/hr), and the subscript "CSTR" is used to identify the steady state operation of a reactor configuration in which solids are continuously introduced into the reactor and the mixing characteristics of the solids within the reactor are well-mixed. Comparing equation (6) and equation (8) associated with the fed-batch and continuous processes, respectively, two additional deficiencies to the proposal in British patent 759,720 to relate the fed batch process findings to a continuous well-mixed fluid bed coking process can be identified, in addition to the three stated above.

4. The continuous process can accept incrementally more feed per unit mass of bed solids than the fed batch process by an amount equal to $S\alpha_{KC}(m_K/m_b)^*$. In descriptive terms the circulation of solid particles introduces a second mechanism through which to introduce dry solids into the reactor, in addition to drying out the wet particles through chemical reaction. This result indicates that the relationship disclosed British patent 759,720 is highly conservative.
5. Unlike the relationship disclosed in British patent 759,720 only one of the two process variables affecting the maximum amount of feed that can be added to the reactor is temperature dependent, while the other is not. The rates of all chemical reactions are temperature dependent. For the cracking reactions considered here the rates increase exponentially with increasing temperature. Therefore, the rate at which the solids dry out in the reactor is highly sensitive to temperature. It follows that increasing temperature will allow both the continuous and fed batch reactors to accept more feed before defluidizing, since the feed rate is proportional to the rate of reaction in both cases.

In a continuous reactor where the mixing characteristics are plug flow there is no mixing in the direction of flow of the solid particles. For a plug flow reactor of length L (ft) in which the feed is introduced instantaneously at the point of entry of the solids into the reactor, the concentration of the reacting pitch fraction at any location Z (ft) along the length of the reactor is given by the equation:

$$\left(\frac{m_K}{m_b}\right)_Z = \left(\frac{m_K}{m_b}\right)_0 \exp\left[-k_K\Big|_Z \left(\frac{m_b}{S}\right)\frac{Z}{L}\right] \quad \text{equation (9)}$$

where $(m_K/m_b)_z$ is the concentration at any location z in the reactor, and $(m_K/m_b)_0$ is the concentration at the entrance location. Note that unlike the continuous or fed batch arrangements, the temperature is not uniform in the plug flow reactor, and drops continuously in the direction of flow. Hence $k_K|_z$ is used to refer to the rate constant at any position in the reactor. The details of the derivation is known in the art, and for example, can be found in Fogler, H. S., "Elements of Chemical Reaction Engineering", Prentice-Hall, Englewood, N.J., 1986, or Smith, J. M., "Chemical Engineering Kinetics", Third Ed., McGraw-Hill Book Company, New York, N.Y., 1981.

From inspection of this equation the concentration of the heavy reacting material is largest at the location Z=0. Hence the risk of defluidization is greatest in a plug flow reactor at the location where the feed is introduced.

At the location Z=L the mass of coke per mass of fresh bed solids is necessarily given by quantity $F\Delta_{CCR}\pi/S$. This quantity of coke is related to the mass of the reacting pitch fraction introduced onto the solids at the location Z=0 through stoichiometry, yielding the equality:

$$\left(\frac{m_K}{m_b}\right)_0 = \frac{F\Delta_{CCR}\pi}{\alpha_{KC}S} \qquad \text{equation (10)}$$

Therefore to avoid defluidization $$(F)_{PLUG} \leq \frac{\alpha_{KC}(m_K/m_b)^*}{\Delta_{CCR}\Pi}[S] \qquad \text{equation (11)}$$

where the subscript "PLUG" is used to differentiate the plug flow reactor type.

Some observations can be made when comparing the continuous plug flow and well mixed systems to which fresh solids are continually advected. First, the well mixed CSTR system has the ability to accept more feed, since the tacky solids that are dried out are back mixed in with the rest of the bed solids, providing an additional mechanism to reduce the concentration of tacky solids in the bed. The incremental amount of feed that can be added in the well mixed system is dependent upon temperature. Second, the maximum amount of feed that can be accepted by the plug flow reactor is not dependent upon temperature, whereas the well mixed reactor contains a temperature-dependent termed as described. Third, the temperature independent term in the CSTR formulation is the same as that for the plug flow.

This result brings to light further issues with the findings disclosed in British patent 759,720.

The maximum feed rate that a plug flow reactor can accept is not dependent upon temperature, or on the mass of fluidized solids in the bed. Therefore, while the findings in British patent 759,720 would provide a conservative operating condition for the continuous, well mixed system, the findings in this patent would have no relevance whatsoever to a plug flow arrangement.

Comparing the results above, it is apparent that there are two factors that impact the maximum concentration of tacky material in the reactor, and hence the ability of the particular reactor configuration to resist defluidization by bogging. The first is the backmixing of dry solids in the reactor, and the second is the advection of dry solids into the reactor. The FB configuration relies solely on the backmixing of solid within the reactor to resist bogging, while the PLUG configuration relies solely on the advection of fresh solids. The CSTR configuration incorporates both backmixing and advection. Mathematically the maximum feed rate that can be fed to the CSTR to avoid bogging is the sum of the fed batch and plug flow derivations, and equation (8) is equal to the sum of equation (6) and equation (11).

Figure 4:
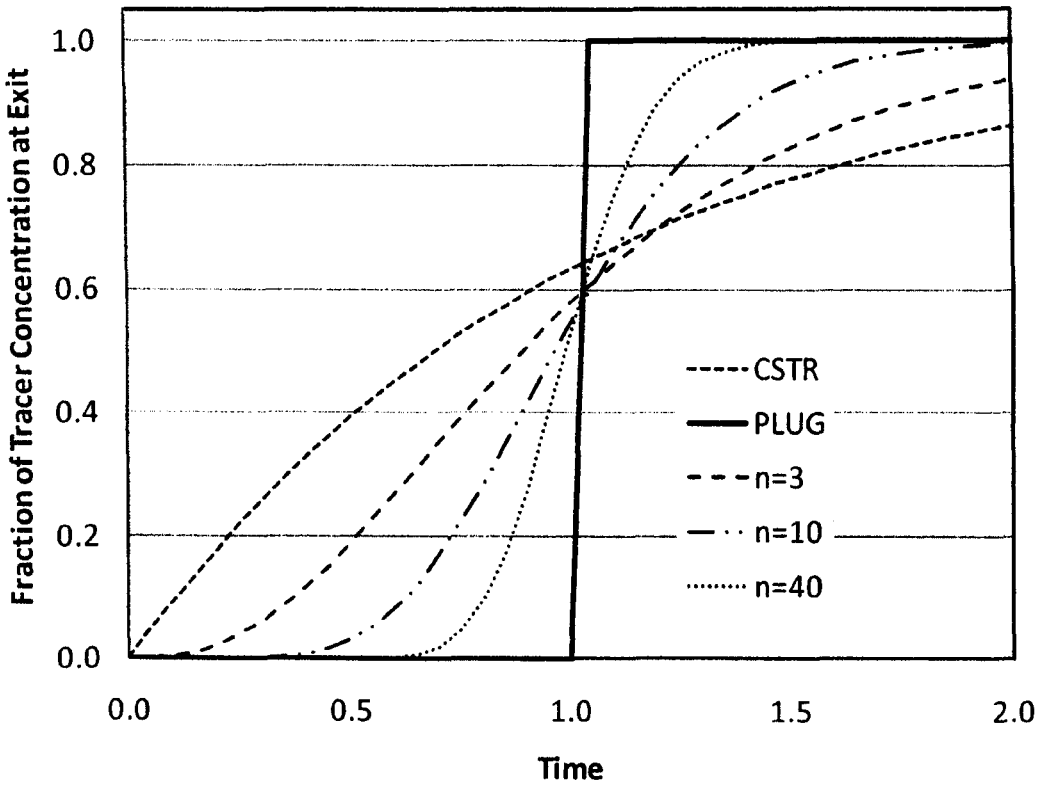
FIG. 4 is a graph showing how the mixing model introduced in the invention is capable of covering the full range of conditions expected in its application.

While the extremes of no backmixing (plug flow) and complete backmixing (CSTR) are useful concepts, there are cases in real processes where the degree of backmixing lies somewhere in between these two extremes. By definition plug flow represents the case where the reactor volume consists of a series of CSTR units, each occupying the full cross section of the reactor, but each of infinitesimal volume. At the other extreme, in contrast to the infinite number of well-mixed subunits that formulate the plug flow reactor, the CSTR reactor can be viewed as comprising a single CSTR unit. Therefore, reactor configurations with degrees of backmixing between the PLUG and CSTR cases can be modeled by considering the reactor as being as a number of CSTR units in series, where the number is between unity and infinity. This concept has indeed found utility in practice in describing the mixing characteristics of various reactor configurations (see, for instance, Fogler, supra). FIG. 4 shows how the CSTR in series reactor model is capable of describing the full range of mixing characteristics, from fully mixed to the no backmixing condition, by dividing the reactor into an integer number (n) of serial well-mixed volume elements of equal size.

In practice it may not be possible or desirable to introduce the desired quantity of feed into only the first volume element of a particular reactor configuration. If the mixing condition of the solids in the reactor is characterized by n elements of equal volume using the CSTR-in-series description, and the feed is introduced over the first p volume elements, where p≤n, the maximum concentration will occur in the final element of this subset. Assuming each of the n elements receives the same amount of feed, which is practically the case in commercial applications, the total amount of feed that can be introduced without bogging can be derived by considering a series of volume elements, and constraining the exit concentration of element p to be less than $\alpha_{KC}(m_K/m_b)^*$. The solution to this problem must consider the fact that although the temperature is uniform within each of the n elements, the temperature will drop along the length of the reactor due to process requirements and heat losses to the surroundings, so that $T_{i+1}<T$, where $T_i$ is the temperature in any given volume element. Considering these temperature differences, the amount of feed that can be introduced to each of the p equal volume elements so that the maximum concentration does not exceed $\alpha(m_K/m_b)^*$ is given by the equation:

$$F \leq \frac{pS}{\Delta_{CCR}\Pi}\frac{\left[C_1\prod_{i=1}^{p}\left(k_K\big|_i\frac{m_b}{nS}+1\right)-(m_K/m_b)_0\right]}{1+C_3} \qquad \text{equation (12)}$$

$$C_3 = \begin{cases} 0 & p = 1 \\ \sum_{j=1}^{p-1}\left(\prod_{i=1}^{j}\left(k_K\big|_i\frac{m_b}{nS}+1\right)\right) & p > 1 \end{cases}$$

where $C_1=\alpha_{KC}(m_K/m_b)^*$, $C_2=E_a/R$, and $k_K|_i$ is the first order rate constant ($hr^{-1}$) associated with volume element i, related to temperature by the expression $k_K|_i=A\exp(-C_2/T_i$. The quantity $(m_K/m_b)_0$ represents the amount of the reacting liquid pitch fraction contained on the fluidized solids entering the reactor.

The parameter $C_1$ represents the quantity of coke that will be formed from the reacting pitch fraction feed residing on the fluidized solids at the point of bogging, expressed as a concentration (kg coke produced/kg bed solids). Any incremental feed introduced to the fluidized bed under these conditions will cause the bed to defluidize. This parameter is determined experimentally, as will be described.

The parameter $C_2$ represents the activation energy for the reaction of the heavy hydrocarbon liquids. This value has been found to be relatively constant for heavy petroleum fractions, varying less than ~7% about a value of 53 kcal/mol for a wide range of gasoils, light hydrocarbon fractions, and asphalt. (Raseev, S., "Thermal and Catalytic Processes in Petroleum Refining", Marcel Dekker, Inc., New York, 2003).

With these definitions it is clear that the fraction of the fluidized bed that has been characterized by the parameter n that is receiving feed is given by the ratio $\epsilon$=p/n. With $\epsilon$ as the independent variable, p can be determined by the integer value of the product of $\epsilon$ and n, given mathematically as p=INT($\epsilon$n).

The above relationship captures the complete range of mixing conditions, and is illustrated in FIG. 4. It can be seen from this Figure that:

Where the entire fluidized bed is well mixed, and the entering solids are dry, then n=p=1, and equation (12) collapses to the CSTR definition described by equation (8).

The plug flow situation is represented by the case where n is large, and p=1. If the entering solids are dry, then equation (12) collapses to the plug flow limit described by equation (11).

Determining the Mixing Characteristics "n" and "p" of a Commercial Fluidized Bed Methods for determining the mixing characteristics "n" and "p" of a reactor vessel are well known in the art. One approach is described below:

1. Construct a scale model of a fluidized bed that has identical mixing characteristics to the commercial-scale fluidized bed coking reactor which will carry out the improved coking process. The methodologies for scaling a fluidized bed process with respect to mixing are known in the art, and can be found for example in "Handbook of Fluidization and Fluid-Particle Systems" (W.-C. Yang, ed., supra), or "Fluidization Engineering" (J.-M. Smith, supra).
2. Operate the fluidized bed at steady state under similar conditions to those expected during commercial operation. Under steady state conditions all measureable parameters do not change with time.
3. At a specific instance introduce a known quantity of "tracer particles" instantaneously into the reactor that are differentiable from the bulk inventory of particles. For instance, the particles may be of slightly different size than the bulk inventory. Alternatively, the solids may be labeled with a dye, or some other discernable feature.
4. Measure the concentration of tracer particles with time, C(t), until the entire charge of tracer particles added have been accounted for. The method with which the tracer particles are measured depends upon the feature used to differentiate them from the bulk inventory. For instance, if the tracer solids are coated with a dye, the tracer particles could be identified using an appropriate light-based technique. If size were used as the identifying feature, then the particles could be measured using size exclusion and screening techniques.
5. Determine the value of the "Residence time distribution function" at each of times for which data were collected, E(t), by dividing the concentration at that time C(t) by the total amount of tracer particles added.
6. Calculate the "space time", $\tau$ (min) using the equation:

$$\tau = \frac{m_b}{S} \qquad \text{equation (13)}$$

7. Calculate the "dimensionless time" ($\Theta$) by dividing the time at which the tracer concentration was measured, by the space time.
8. Calculate the parameter n in equation (12) using the experimental values for E(t) determined above, and the relationship:

$$n = \left[\int_0^\infty (\Theta - 1)^2 E(\Theta)\, d\Theta\right]^{-1} \qquad \text{equation (14)}$$

where n represents the total number of volume elements that represent the fluidized bed.

9. Fix p which is simply the number of volume elements in which feed material is fed onto the fluidized bed of solid particles. This parameter is set by the physical design of the reactor, and in particular the location of the feed injection points.

The derivation of equation (14) can be found in standard reaction engineering text books, including those authored by Smith, and by Fogler. Evaluation of equation (14) is carried out using the data generated as described above, and standard numerical methods.

An example of this approach has been applied to the applicant's own cross flow coking bed process described in 2,505,632. A 0.5 scale model was constructed and a phosphorescent particles energized with ultraviolet light were injected into the bed. The presence of the tracer particles were detected at various locations. Applying the equations provided above the parameter n associated with the reactor was found to have a value of 15.

Generalized Feeding Strategy

As noted previously, it is desirable to operate a fluidized bed coking reactor to process as much feed material, and hence produce as much product as possible without causing the fluidized bed to defluidize, or worse still, to bog. The improved coking process therefore comprises an upper feed rate limit of feed material for the reactor that is defined from the derivations described previously. In particular, the upper feed rate limit of feed material is determined from equation (12), which is reproduced below as equation 18, except with feed rate F defined as "$F_{MAX}$":

$$F_{MAX} \le \frac{pS}{\Delta_{CCR}\Pi} \frac{\left[C_1 \prod_{i=1}^{p} \left(k_K\big|_i \frac{m_b}{nS} + 1\right) - (m_K/m_b)_0\right]}{1 + C_3} \qquad \text{equation (15)}$$

$$C_3 = \begin{cases} 0 & p = 1 \\ \sum_{j=1}^{p-1} \left(\prod_{i=1}^{j} \left(k_K\big|_i \frac{m_b}{nS} + 1\right)\right) & p > 1 \end{cases}$$

The reactor can be operated safely at any feed material feed rate that is lower than the upper feed rate limit. However, it may be desirable to supply the feed material to the reactor at a rate that is within an optimal range which is safe but yet outputs product at an acceptably productive rate, and in such cases the improved coking process can include a lower feed rate limit. Because the reactor can ideally approach a pure plug flow state, the lower limit of the optimal feed rate range is determined for the plug flow case from equation (12), with p=1 and n=∞. Under these conditions equation (12) collapses to equation (11), which is reproduced below as equation 19 except with "$F_{PLUG}$" replaced with "$F_{MIN}$":

$$F_{MIN} = \frac{S}{\Delta_{CCR}\Pi} C_1 \quad \text{equation (16)}$$

The lower feed rate limit determined in this manner represents the most conservative feed material feed rate required to avoid defluidization. Lower rates will avoid defluidization, but may penalize process economics.

Determining the variables for equation (15) and equation (16) were previously discussed and are summarized below:

1. As discussed in the above section entitled "Determining the Mixing Characteristics "n" and "p" of a Commercial Fluidized Bed", the mixing characteristics parameter n is used to describe the mixing characteristics of the commercial reactor configuration, encompassing the region of the reactor where the feed will be introduced.
2. S represents the mass flow rate (lb/hr) of the solid particles fed through the reactor 20 and is a parameter that can be controllably varied by the operator to match a desired feed rate, as governed by the appropriate limiting equation.
3. The coke producing factor π (lb/lb) is the weight of coke actually produced in the reactor 20 divided by the CCR of the feed material, and can be measured by an operator of the reactor 20 using standard industry test methods. The CCR content of the feed is often provided by the feed material supplier. Typically for the reactor 20 of this embodiment, a π of about 1 (1 lb of coke produced per 1 lb CCR in the liquid feed) is expected. In general, a CPF of 1-2 is expected, depending upon the specific reactor technology deployed in reactor 20.
4. $\Delta_{CCR}$ is the change in the amount of coke forming material in the feed material after having been reacted in a fluid bed reactor. The CCR content of the feed material is typically provided by the feed material supplier, or can be measured from the feed by standard industrial measurement techniques known in the art. The reactor 20 of this embodiment can be operated under conditions to cause a $\Delta_{CCR}$ of about 60-70% in a single pass. In the case where 65% of the CCR is converted on a single pass, the unconverted CCR-containing material is condensed and separated from the liquid products in the fractionating apparatus 18 of FIG. 2, and is recycled to the reactor along with fresh feed. While the remaining pitch material can be repeatedly recycled back to the reactor until the coke forming material in the pitch is fully reacted into coke (100% reaction), it is generally commercially feasible to operate the reactor 20 until only about 94% of the pitch material is reacted.
5. The parameter $C_1$ is related to the maximum concentration of reacting pitch fraction that can be tolerated by the fluidized bed without bogging. This parameter is a function of the feed type, the type of fluidized solids, and the velocity of the fluidization gas. It can be determined empirically, ideally in a small scale fed-batch fluidized bed whose solids mixing characteristics are well mixed. The bed is fed with the feed liquid of interest until the unit defluidizes, defined as $F_{FB,MAX}$. The parameter $C_1$ is then calculated by the fed-batch equation, re-arranged to yield:

$$C_1 = \frac{F_{FB,MAX}\Delta_{CCR}\Pi}{m_b A\exp(-C_2/T)} \quad \text{equation (17)}$$

It is recognized that equation (17) represents the special case of equation (12), where the terms S and $(m_K/m_b)_0$ are equal to zero, and n=p=1. While the fed-batch configuration is a convenient means of determining the parameter $C_1$ as described, it is recognized that any reactor can be used for this purpose, provided that the mixing characteristics are known. A discussion on how to determine the mixing characteristics is described above.

6. $m_b$ is the inventory of fluidized solids in the bed prior to feed introduction (lb) and can be measured.
7. $k_K|_i$ is the rate constant at any position i in the reactor (1/hr), determined by the equation $k_K|_i = A\exp(-C_2/T_i)$.
8. $T_i$ is the reactor temperature at any location i in the reactor (° C.), and can be measured continuously using an industrial instrument, such as a thermocouple. The kinetic constants A and $C_2$ correspond to the disappearance of the reacting pitch fraction. They are dependent upon the properties of the reacting pitch. For the hydrocarbon mixtures typically processed in fluid bed coking reactors the parameter, $C_2$ has been found to be relatively constant across a wide range of petroleum fractions (see for example, Raseev, supra). A and $C_2$ for many different feeds have been tabulated are and readily available in the public domain. Alternatively, A and $C_2$ can be determined from experimentation on a bench top in a non-fluidized system in a manner known in the art (see for example, Smith, supra, or Fogler, supra).
9. $(m_K/m_b)_i$ represents the concentration of liquid feed on the solids entering the fluid bed, which can be measured However, in most cases this term will be zero, as the solids entering the reactor will be free of feed material.

On-Line Control

The generalized feeding strategy of the improved coking process as described above can be implemented as a program executed by an automated supervisory controller that controls certain subsystems of a fluidized bed coking reactor, such as the cross-flow fluidized bed reactor 20 shown in FIG. 3. In particular, the program can be executed by the supervisory controller to maintain the feed at a feed material set point feed rate $F_{SP}$ under $F_{MAX}$ and optionally between an optimal range limited by $F_{MAX}$ and $F_{MIN}$.

Figure 5:
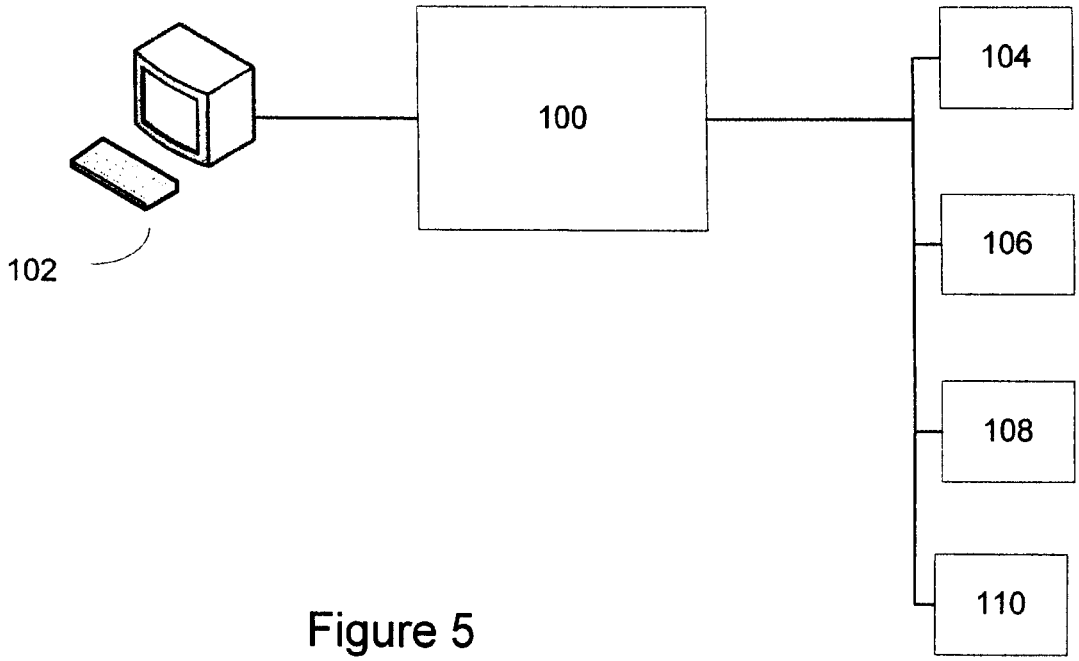
FIG. 5 is a schematic of a controller having a memory encoded with steps and instructions for controlling the feed rate of the reactor.

A supervisory controller is a controller that controls a number of individual subsystem controllers. The supervisory controller has information on how a number of subsystems interact. Based on the status of these subsystems, and other measured inputs, the supervisory controller interacts with the controllers of the various sub-systems usually by adjusting the set-points of variables controlled by the sub-system controllers. In this embodiment, the supervisory controller is a programmable logic controller 100 as shown in FIG. 5. A user interface device 102 such as a keyboard and computer display is connected to the supervisory controller 100 to allow an operator to input parameters into the controller 100 and to monitor the operation of the reactor 20; the user interface device 102 can be locally connected to the controller or remotely connected, e.g. via a network connection. The controller 100 is communicative with the reactor 20, and in particular receives temperature sensor data from a series of temperature sensors 104 located along the length of the reactor vessel 20.

The subsystems controlled by the supervisory controller 100 in this embodiment are the functional elements of the reactor, namely the solids feed mechanism 106, the fluidization gas injector 108, and the feed material feed mechanism 110. The supervisory controller 100 manipulates the set points of these subsystems 106, 108, 110 to make sure that the upper feed rate limit $F_{MAX}$ is never exceeded. This is accomplished typically by adjusting a feed material set point feed rate $F_{SP}$ of the feed material feed mechanism 110. The solids rate S set point of the solids feed mechanism 106 can also be adjusted, but the adjustability of this rate can be constrained by the typical requirement that the solids be dry upon exiting the reactor 20. The fluidization gas set point of the fluidization gas injector 108 can also be adjusted, but the adjustability of this rate can be constrained by certain equipment in the hydrocarbon processing system 10, such as gas/solids separation equipment (not shown).

The supervisory controller 100 has a memory encoded with the generalized feeding strategy program which is executable by the controller 100 to carry out the generalized feeding strategy in the following manner:

1. Based on the properties of the reactor 20 and the selected feed material 40, as well as certain operating parameters of the reactor 20, values for the following parameters are determined in the manner described under "Generalized Feed Strategy" and inputted via the user interface device 102 and stored on the memory of the supervisory controller 100: $C_1$, $C_2$, p, n, $\pi$, $\Delta_{CCR}$, $m_b$, A, $E_o$ and R.
2. A solids mass flow rate S of the solids feed mechanism 106 is selected and inputted into the supervisory controller 100 via the user interface device 102 or via another input device (not shown) communicative with the solids feed mechanism 106. The supervisory controller 100 then sends a control signal to the solids feed mechanism 106 to feed the solids through the reactor 20 at the selected solids mass flow rate. The solids mass flow rate through the reactor 20 is continuously monitored and this data is sent back to the supervisory controller 100.
3. The operating feed material set point feed rate $F_{SP}$ is set to an initial feed rate and inputted onto the supervisory controller 100 via the user interface device 102 or via another input device (not shown) communicative with the feed material feed mechanism 110. The supervisory controller 100 then sends a control signal to the feed material feed mechanism 110 to feed the feed material into the reactor 20 at the selected initial feed rate.
4. The temperature $T_i$ at different locations in the reactor 20 are continuously monitored by the temperature sensors 104 to define a temperature profile and this data is sent to the supervisory controller 100.
5. The supervisory controller 100 repeatedly executes an algorithm embodying equation (15) to continuously determine the upper feed rate $F_{MAX}$ using the measured value of the solids mass flow rate S, the measured value of the reactor temperature profile T, and the inputted parameters listed in paragraph 1.
6. If applicable, the supervisory controller 100 repeatedly executes an algorithm embodying equation (16) to continuously determine the lower feed rate $F_{MIN}$ using the measured value of the solids mass flow rate S and the parameters listed in paragraph 1.
7. The supervisory controller 100 executes an algorithm which compares $F_{SP}$ to $F_{MAX}$ and, if applicable, $F_{MIN}$, as determined in paragraphs 5 and 6. If $F_{SP}$ is not within the optimal feed material feed rate range, then the supervisory controller 100 sends a control signal to the feed material feed mechanism 110 to adjust $F_{SP}$ until this rate falls within the optimal feed material feed rate range, or adjust S to change $F_{MAX}$ and $F_{MIN}$.

It is understood that the controller parameters associated with proportional, derivative, and integral action will have to be optimized as would be known to one skilled in the art.

While exemplary embodiments of the invention have been illustrated and described, it will be appreciated that various changes can be made therein without departing from the scope and spirit of the invention.

The invention claimed is:

1. A method of operating a fluidized bed coking reactor comprising:

(a) feeding heated solid particles into the reactor at a selected mass flow rate ("S") and forming a fluidized bed of the solid particles;

(b) determining a degree of backmixing of the solid particles in the fluidized bed;

(c) monitoring a temperature profile ("T") in the reactor;

(d) feeding a feed material onto the fluidized bed of the solid particles at a feed material set point feed rate ("$F_{SP}$");

(e) determining an upper feed material feed rate ("$F_{MAX}$") which is a feed material feed rate that causes defluidization in the reactor when the reactor is operating at the monitored temperature profile and when the solid particles have the selected mass flow rate and the determined degree of backmixing and wherein the upper feed material feed rate is a function of the solid particles, mass flow rate, the reactor temperature profile, mixing characteristics of the reactor, and properties of: the feed material, the solid particles, and a fluidization gas fed into the reactor; and (f) comparing the feed material set point feed rate to the determined upper feed material feed rate and in response to determining that the feed material set point feed rate is greater than the upper feed material feed rate, adjusting the feed material set point feed rate so that the feed material set point feed rate is at or below the upper feed material feed rate.

2. A method as claimed in claim 1 wherein the degree of backmixing is determined by modeling the reactor as a selected number ("n") of serial well-mixed volume elements of equal size.

3. A method as claimed in claim 2 wherein each of the well-mixed volume elements is modeled by a continuous well-mixed reactor.

4. A method as claimed in claim 3 wherein the feed material is fed onto the fluidized bed over a selected number ("p") of well-mixed volume elements.

5. A method as claimed in claim 4 further comprising determining a lower feed material feed rate ("$F_{MIN}$") being a feed material feed rate that causes defluidization in the reactor when the reactor is operating under continuous plug flow conditions, and when the feed material set point feed rate is lower than the lower feed material feed rate or higher than the upper feed material feed rate, adjusting the feed material set point feed rate or the solid particles, mass flow rate so that the feed material set point feed rate is between the upper and lower feed material feed rates.

6. A method as claimed in claim 5 wherein $F_{MIN}$ is defined by a lower feed rate algorithm being a product of the mass flow rate of the solid particles and a quantity of coke that will be formed from the feed material contained on the fluidized bed of solid particles at a point of bogging per quantity of solid particles ("$C_1$") divided by a product of a coke producing factor for the feed material in the reactor ("$\pi$") and a change in an amount of coke forming material in the feed material after having been reacted in the reactor ("$\Delta_{CCR}$").

7. A method as claimed in claim 6 wherein π is between one and two.

8. A method as claimed in claim 6 wherein ΔCCR is between 0.65 and 1.0.

9. A method as claimed in claim 8 wherein ΔCCR is 0.94.

10. A method as claimed in claim 6 wherein $F_{MAX}$ is defined by an upper feed rate algorithm $$\frac{C_1}{\Delta_{CCR}\Pi}\left[\frac{m_b}{n}A\exp(-C_2/T)+S\right],$$

wherein $m_b$ is a mass of fluidized solid particles in the reactor prior to an introduction of feed material, A is a kinetic constant corresponding to a disappearance of a reacting pitch fraction and $C_2$ is an activation energy for a reaction of the reacting pitch fraction.

11. A method as claimed in claim 10 wherein $F_{MAX}$ is defined by an upper feed rate algorithm $$F_{MAX} \le \frac{pS}{\Delta_{CCR}\Pi}\frac{\left[C_1\prod_{i=1}^{p}\left(k_K\big|_i\frac{m_b}{nS}+1\right)-(m_K/m_b)_0\right]}{1+C_3}$$

-continued $$C_3=\begin{cases}0 & p=1\\ \sum_{j=1}^{p-1}\left(\prod_{i=1}^{j}\left(k_K\big|_i\frac{m_b}{nS}+1\right)\right) & p>1\end{cases}$$

wherein p=INT(ϵn), $k_K|_i=A\exp(-C_2/T_i)$ , and $(m_K/m_b)_0$ represents an amount of a reacting pitch fraction contained on the solid particles entering the reactor, and wherein subscript "i" refers to a location in the reactor between 1 and j.

12. A method as claimed in claim 11 wherein the lower feed rate algorithm and the upper feed rate algorithm are stored on a memory of a supervisory controller that is communicative with a temperature sensor inside the reactor and functional elements of the reactor including a feed material feed mechanism and a solids feed mechanism, and wherein the method further comprises storing values for $C_1$, $C_2$, p, n, π, $\Delta_{CCR}$, $m_b$, and A in the memory, executing the lower and upper feed rate algorithms on the supervisory controller to determine values for $F_{MAX}$ and $F_{MIN}$, and sending a control signal from the supervisory controller to the reactor to feed material at the feed material set point feed rate $F_{SP}$.

13. A method as claimed in claim 12 further comprising monitoring S and T, and when either of these values change, executing the lower and upper feed rate algorithms to recalculate values of $F_{MAX}$ and $F_{MIN}$.

* * * * *